US005816411A

United States Patent [19]

Smith

[11] Patent Number: 5,816,411

[45] Date of Patent: Oct. 6, 1998

[54] SNACK PACKAGE ASSEMBLY

[75] Inventor: Michael J. Smith, Orangeburg, N.Y.

[73] Assignee: Arrow Art Finishers, L.L.C., Bronx, N.Y.

[21] Appl. No.: 764,598

[22] Filed: Dec. 11, 1996

[51] Int. Cl.[6] ..... B65D 77/00

[52] U.S. Cl. ..... 206/782; 206/769; 206/218; 206/765

[58] Field of Search ..... 206/218, 216, 206/782, 783, 775, 756, 759, 765, 769, 772, 773

[56] References Cited

U.S. PATENT DOCUMENTS

| | | | |
|---|---|---|---|
| 3,835,987 | 9/1974 | Growney | 206/769 |
| 4,109,786 | 8/1978 | Roccaforte et al. | 206/783 |
| 4,925,087 | 5/1990 | Ostrander | 206/775 |
| 5,005,701 | 4/1991 | Dutcher | 206/775 |
| 5,609,248 | 3/1997 | Rohrbough et al. | 206/216 |

*Primary Examiner*—Paul T. Sewell
*Assistant Examiner*—Nhan T. Lam
*Attorney, Agent, or Firm*—Kirschstein, et al.

[57] ABSTRACT

A snack package assembly includes a package having top and bottom walls as considered in a position of use thereof, and a plurality of circumferentially adjacent main panels interconnecting the top and bottom walls. A plurality of edge portions includes a substantially horizontally extending bottom edge portion for delimiting at least one opening in at least one of the main panels for providing access to the interior of the package. At least one flap section is connected to the one main panel along the bottom edge portion and extends into the interior of the package in a substantially horizontal position as considered in the use position to subdivide the interior into an upper and a lower compartment. At least one substantially rigid container containing an edible flowable substance is accommodated in the lower compartment and supports the flap section from below to form a supporting platform. At least one other container containing a multitude of essentially solid items is accommodated in the upper compartment and is supported by the platform.

19 Claims, 9 Drawing Sheets

SNACK PACKAGE ASSEMBLY

BACKGROUND OF THE INVENTION

1. Field of the Invention

The present invention relates to packaging of food items in general, and more particularly to a snack package assembly that includes a package for different kinds of containers, each containing different and disparate substances or snack items destined for human consumption in different compartments provided for them in the interior of the package.

2. Description of the Related Art

There are already known various constructions of foodstuff and/or beverage container-accommodating boxes, crates, picnic baskets or even packages and similar receptacles, some of them even being subdivided into smaller compartments in order to separate the individual containers from one another and thus minimize the danger of damage to them when, for instance, in transit. It is also already known to make some of such receptacles open, particularly on top, in order to facilitate the access to the items contained in the interior of the receptacle or in the compartments into which the interior may be subdivided.

Moreover, some fast food establishments provide "trays", especially for takeout orders, which are actually not (flat) trays in the traditional sense of the word but rather holding/carrying formations made of, say, paper pulp material that are provided with a plurality of depressions some of which may be shaped differently from others in order to somewhat snugly receive the bottom portions of different kinds and/or sizes of food or beverage containers or the like. While the latter type comes in particularly handy not only in traditional takeout situations at drive-by windows, they are also very convenient to use at, for instance, sports events, in that they minimize, if not eliminate, the otherwise existing danger that the food items and especially the contents of beverage cups or similar containers could land on innocent bystanders or other sports event onlookers.

Yet, as advantageous as these receptacles may be for the purposes for which they have been developed, they are still deficient in at least one respect: they for the most part are not suited for conveniently carrying the food and/or beverage containers containing just about the right amount of such foodstuffs for the outing in question in a manner that is convenient, unobtrusive to other attendees of the event, and also holds the threat of breakage of, or other damage to, any of the food/beverage containers being carried or otherwise transported to and/or through the sports facility or the like at which the event is to take or is taking place.

OBJECTS OF THE INVENTION

Accordingly, it is a general object of the present invention to avoid the disadvantages of the prior art.

More particularly, it is an object of the present invention to provide a snack package assembly that does not possess the drawbacks of the known receptacles for accomplishing the same or similar purpose.

Still another object of the present invention is to devise a snack package assembly of the type here under consideration which is capable of accommodating, in separate compartments, different types of containers having different contents and different characteristics so that they could easily damage one another or each other's contents if left loose to conduct relative movements in contact with one another.

It is yet another object of the present invention to design the above in such a manner as to make the putting of the assembly together, but also the removal of the individual items from the outer package, as simple as possible.

A still further object of the present invention is to develop the assembly of the above type in such a manner as to minimize, if not eliminate, the possibility of movement of at least the relatively heavy and solid containers within the outer package.

A concomitant object of the present invention is so to construct the snack package assembly of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a snack package assembly that includes a package having top and bottom walls as considered in a position of its use, and a plurality of circumferentially adjacent main panels interconnecting the top and bottom walls. The snack package assembly also includes a plurality of edge portions including a substantially horizontally extending bottom edge portion for bounding at least one opening in at least one of the main panels for providing access to the interior of the package; and partitioning means including at least one flap section connected to the one main panel along the bottom edge portion and extending into the interior of the package in a substantially horizontal position as considered in the use position to subdivide the interior into an upper and a lower compartment, each for accommodating different snack items.

There is further provided at least one substantially rigid container containing an edible flowable substance, accommodated in the lower compartment and supporting the partitioning means from below to form a supporting platform, and at least one other soft-packaged container containing a multitude of essentially solid items, accommodated in the upper compartment and supported by the platform.

A particular advantage of the assembly as defined so far is that the partitioning means effectively separates the containers of disparate qualities, that is the one that is relatively rigid but possibly fragile or prone to be otherwise damaged if allowed to excessively move within the package, and the relatively softer one containing solid, but easily breakable or otherwise disintegrateable, goods that could become damaged if subjected to impacts directed at them by the moving rigid container, so that each of them can be protected from damage in the way best suited for its particular qualities or characteristics.

It is especially advantageous in accordance with the present invention when the main panels include at least one other main panel located across the interior from the one main panel, and another plurality of edge portions including a substantially horizontally extending other bottom edge portion for bounding at least one other opening in the other main panel, and when the partitioning means further includes at least one other flap section connected to the other main panel along the other bottom edge portion and extending into the interior of the package in a substantially horizontal position as considered in the use position to supplement the one flap section in partitioning the interior into the two compartments.

According to another aspect of the present invention, it is advantageous for the snack package assembly to further include supporting means additional to the at least one rigid container for supporting the partitioning wall from below.

Such supporting means may include an additional flap section secured to a region of the flap section that is remote from the edge portion and extending downwardly from the region into bracing contact with the bottom wall.

According to another feature of the present invention, the snack package assembly further includes means for confining the at least one rigid container against horizontal movement in the lower compartment. Such confining means may include an additional flap section secured to an additional one of the main panels situated next to the one main panel and extending therefrom substantially horizontally into the lower compartment, the additional flap section having an aperture therein for unobstructed passage of an upper end portion of the one rigid container through it with at most a small leeway. However, in the alternative, the confining means may includes a pair of auxiliary flap sections secured to an additional one of the main panels situated next to the one main panel and extending therefrom substantially vertically into the lower compartment and into physical contact with the one rigid container.

In another alternative, the confining means may include a pair of additional flap sections extending substantially vertically through the lower compartment into contact with the bottom wall, and a pair of further flap sections securing the additional flap sections to, and holding the same at a predetermined distance from, additional ones of the main panels flanking the main panel at respective upper regions of the additional flap sections and in frictional contact with the at least one rigid container. In the latter case, it is further proposed in accordance with a further aspect of the present invention that the confining means further include at least one pair of auxiliary flap sections secured to the one main panel and extending therefrom substantially vertically into the lower compartment and into physical contact with a side of the additional panel that faces away from the at least one rigid container.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
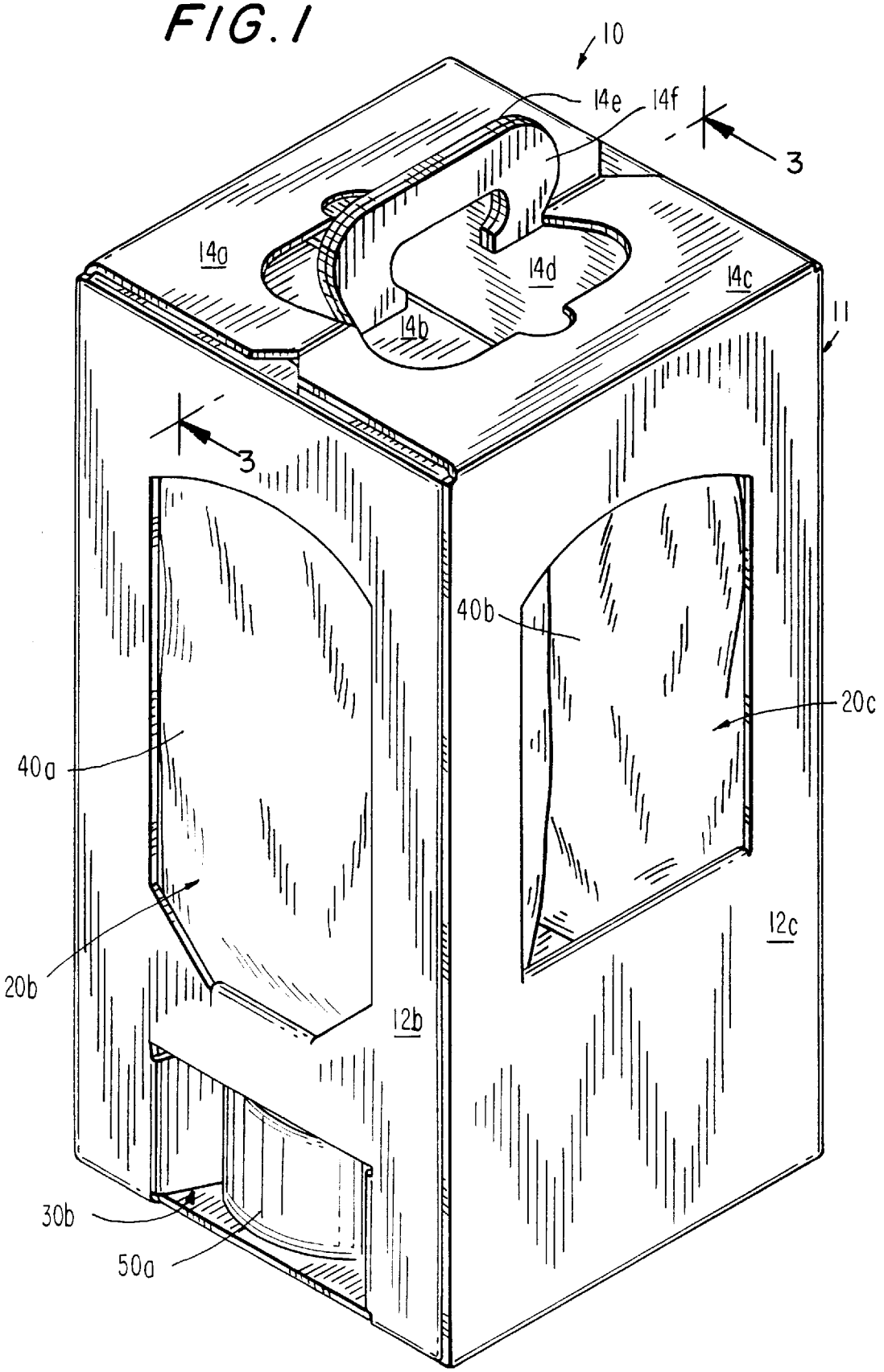
FIG. 1 is a perspective view of a snack package assembly of the present invention.

Referring now to the drawing in detail, and first to FIG. 1 thereof, it may be seen that the reference numeral 10 has been used therein to identify a snack package assembly of the present invention in its entirety. The snack package assembly 10, which is also referred to herein, for the sake of brevity, as a "snack pack", is intended as a convenient transportable source of food and drink especially during attendance of games and sport contests at ballparks, stadiums or the like.

It includes as its main components a portable container or package 11 proper, and compartments for its contents. It may be seen that the container 11 forms the outer envelope of the snack pack 10, whereas the package contents are ordinarily fully received within the confines of the container 11 until such time that it is withdrawn for consumption. As shown, the package contents include two different kinds of goods, namely soft-packaged bags of "chips" identified generally by the reference numeral 40, and more rigid jars of "sauce" designated in general by the reference numeral 50.

In this respect, as well as in others, it is to be mentioned that a reference numeral without any suffix is being used herein to denote either an element or part that is unique, that is, that lacks any counterparts, or a collection or set of parts the individual members of which are distinguished from one another, if necessary, by different suffixes. It is also opportune to mention at this juncture that the expression "chips" has been chosen to represent any of a multitude of kinds of alimentary goods, such as potato or cornmeal chips, crackers, saltines or similar relatively small-sized food items, whereas the word "sauce" is being used as a representation of any of a considerable number of more or less flowable substances, be it salsa or barbeque sauce, ketchup, cheese or other dip, etc. that is intended to be used in conjunction with the "chips", usually by the latter being partially submerged into it just prior to consumption.

Last but not least, it is to be mentioned that all references being had herein with respect to relative locations or various parts, directions, or the like, are intended to refer only to the orientation of the snack pack 10 that is depicted in the drawing, which also happens to be the orientation that the snack pack preferentially assumes while being displayed, transported and otherwise handled prior to the use of its contents; however, no conclusions are to be drawn from these references to the orientation that the snack pack 10 may assume while in storage or while it is being manipulated during the withdrawal of its contents.

Figure 2:
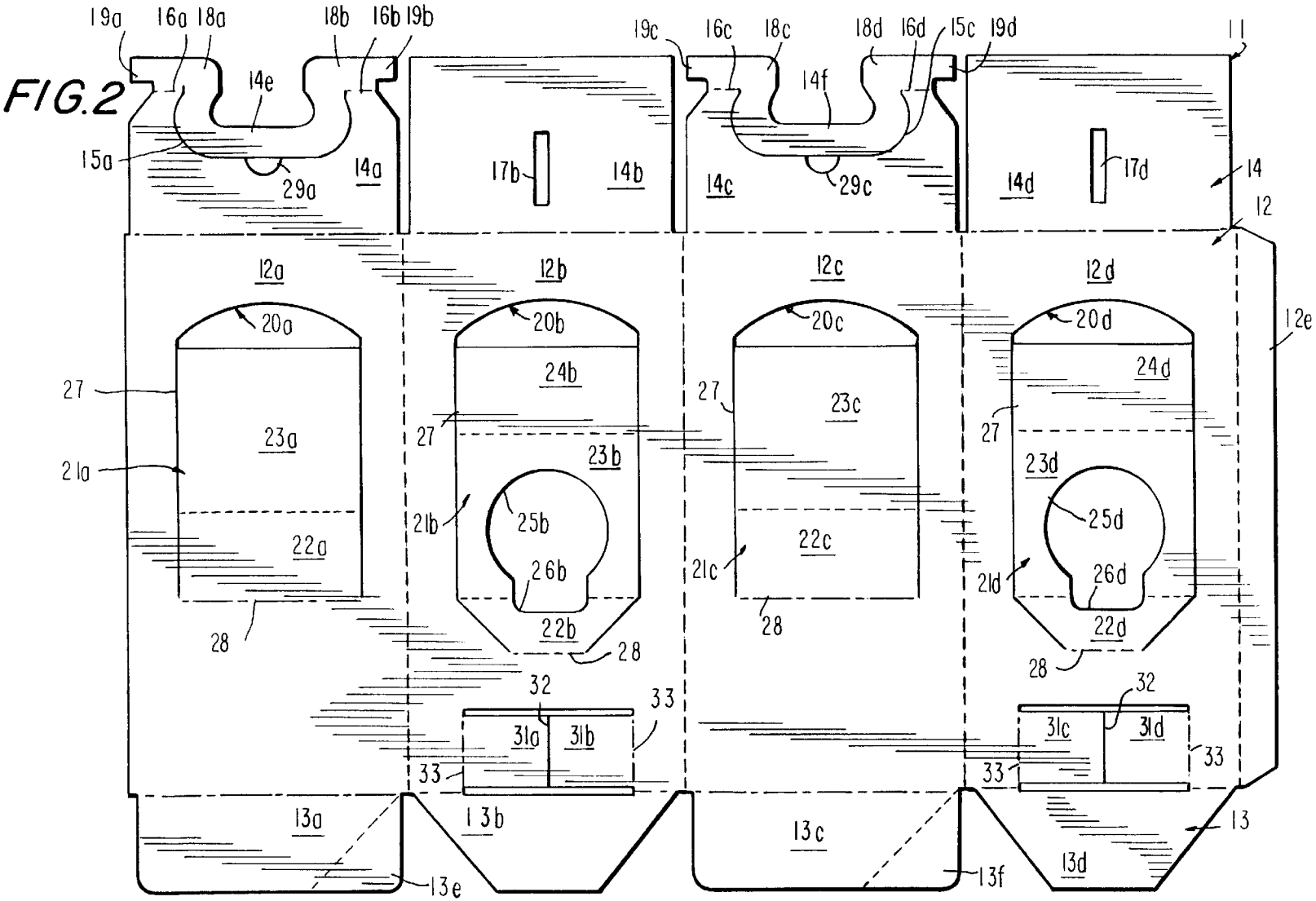
FIG. 2 is a plan view, in a developed condition, of a package precursor that is to form the outer envelope of the assembly visible in FIG. 1 when in its condition of use.

As revealed in common and in particular in detail in FIG. 2 of the drawing, in which the package 11 is shown in its original or as-manufactured state in which it is situated or developed in its entirety into the plane of the drawing prior to being folded into and joined in the shape illustrated in FIG. 1, the package 11 includes a central portion 12 consisting of a plurality of (as shown, four) main panels 12*a* to 12*d* and an adjacent connecting flap 12*e*, a bottom portion 13 including an equally numbered plurality of bottom panels 13*a* to 13*d*, as well as two connecting flaps 13*e* and 13*f*, and a top portion 14 containing a same-numbered plurality of top panels 14*a* to 14*d*, and also a pair of handgrip or handle portions 14*e* and 14*f*.

The handle portions 14*e* and 14*f* are carved out of (separated from) the respective top panels 14*a* and 14*c* by respective cuts (which may have started as merely weakened, such as perforated, zones) 15*a* and 15*c*, respectively, but are still flexibly joined to them by respective hinge zones 16*a* and 16*b* or 16*c* and 16*d*, respectively. The top panels 14*b* and 14*d* include respective slots 17*b* and 17*d* through which respective base regions 18*a* to 18*d* of the handle portions 14*e* and 14*f* pass in the final or erected condition of the container or package 11, these base regions 18*a* to 18*d* being adjoined by respective integral nose regions 19*a* to 19*d* that engage behind the top panels 14*b* and 14*d* next to the slots 17*b* and 17*d* when the container 11 assumes its final condition. In that condition, the flaps 12*e*, 13*e* and 13*f* are permanently connected, such as glued, to respective adjacent central and bottom panels 12*a*, 13*b* and 13*d*, respectively.

Directing attention now to the main panels 12*a* to 12*d*, it may be seen especially from a comparison of FIGS. 1 and 2 that they are all provided with respective openings or "windows" 20*a* to 20*d* (only two of which are visible in FIG. 1) through which the bags 40 can be packed or loaded in the snack pack, can be observed from the exterior of the package 11 for display purposes, and can be withdrawn, after a certain amount of manipulation or maneuvering, from the interior of the package 11. The degree of the manipulation required before the bags 40, or any one of them, can be taken out of the interior of the container 11 through the respective window 20*a* to 20*d* is high enough to prevent the bags 40 from accidentally or inadvertently falling out of the package 11, but low enough not to constitute an undue burden on or considerable inconvenience or even annoyance to the person trying to dislodge the respective one of the bags 40 and take it out of the container 11.

Contrary to what may be expected based on previous experience, the windows 20*a* to 20*d* are not made by merely cutting out and removing the material of the panels 12*a* to 12*d* from the affected regions; rather, such material is only incompletely severed, thus forming respective integral flaps 21*a* to 21*d*, with the flaps 21*a* and 21*c*, on the one hand, and the flaps 21*b* and 21*d*, on the other hand, being similar or identical to one another as to their overall configuration, structure and functionality. The flaps 21*a* and 21*c* include two sections numbered 22*a* and 23*a* or 22*c* and 23*c* each, whereas each of the flaps 21*b* and 21*d* includes three sections 22*b*, 23*b* and 24*b* or 22*d*, 23*d* and 24*d*, respectively. The sections 23*b* and 23*d* are provided with respective apertures 25*b* and 25*d* that are generally substantially circular except that they are each provided with a generally rectangular extension 26*b* or 26*d* that is shown to span the sections 23*b* and 22*b* or 23*d* and 22*d*.

The purpose of the apertures 25*b* and 25*d* and of their extensions 26*b* and 26*d* will be explained later. At this point, it is sufficient to say that the flaps 21*a* to 21*d* are separated from the rest of the panels 12*a* to 12*d* by respective cuts identified, without differentiating between or among them, by reference numerals 27, and pivotally articulated thereto by respective flexible hinge regions 28, once more without differentiation.

In addition to the windows 20*b* and 20*d*, the main panels 12*b* and 12*d* (but not the main panels 12*a* and 12*c* in the illustrated embodiment) are provided with respective additional windows 30*b* and 30*d* (only the window 30*b* being visible in FIG. 1). Here again, the affected material, instead of completely removed, is caused to form respective auxiliary integral flaps 31*a* to 31*d* by being merely partially severed by respective cuts 32 from the rest of the respective main panels 12*b* and 12*d* and from one another, while remaining connected to the panels 12*b* and 12*d* for pivoting by respective hinge auxiliary hinge portions 33.

Here again, the purpose of the windows 30*b* and 30*d* is to permit view of and give access to the jars or other similar sauce containers 50, but not to offer a ready path for withdrawal of the jars 50 from the interior of the package 11. Given the dimensions in question and other factors, such removal through the auxiliary windows 30*b* and 30*d* would entail or require partial ripping or a similar destruction of at least the respective main panel 12*b* or 12*d*, if not of the flap 21*b* or 21*d* as well.

Last but not least, it may be observed in FIG. 2 of the drawing that the top panels 14*a* and 14*c* are provided with respective orifices 29*a* and 29*c* that are geared to providing easier access to the handgrip portions 14*e* and 14*f* for the purposes of moving them out of the planes of the respective panels 14*a* and 14*c* in the course of the erection of the container 11.

Now that the construction of the various panels 12 to 14 and of the flaps 21*a* to 21*d* and 31*a* to 31*d* has been described in some detail, it is time for discussing what happens to the flaps 21*a* to 21*d* and 31*a* to 31*d* when the package 11 is in its final or use condition. It may be discerned, in the succession described, from FIGS. 3 to 6 of the drawing that the flap sections 22*b* and 22*d* depend downwardly from the respective hinge zones 28, that the flap sections 23*b* and 23*d* proceed from there substantially horizontally toward the middle of the package 11, and that the flap sections 24*b* and 24*d* extend from there again downwardly until they reach and brace themselves against the combined bottom panel or wall 13. Along their courses, the flaps 21*b* and 21*d* encounter respective top regions of two jars 50*a* and 50*b*; as a matter of fact, such top regions extend through the apertures 25*b* and 25*d*. To be more precise, respective neck regions 51*a* and 51*b* of the jars 50*a* and 50*b* are received in such apertures 25*b* and 25*d*, while respective lids 52*a* and 52*b* are located above them.

In this manner, the jars 50*a* and 50*b* are retained in place against undue horizontal shifting by the restraining action exerted on them by the respective flaps 21*b* and 21*d*. It will be appreciated that the extensions 26*b* and 26*d* may serve either one or both of the following purposes, depending on the circumstances: for one, they may be used to facilitate the removal of the jars 50*a* and 50*b* from the confining action of the flaps 21*b* and 21*d* by providing extra leeway or wiggling room needed to dissociate the respective jars 50*a* and 50*b* from the flaps 21*b* and 21*d*, especially if the top regions of the jars 50*a* and 50*b* are received in the apertures 25*b* and 25*d* with a relatively tight fit. On the other hand, especially when the diameters of the apertures 25*b* and 25*d* are equal to or even exceed those of the lids 52*a* or 52*b*, the reduced transverse dimension of the respective extension 26*b* or 26*d* relative to that of the aperture 25*b* or 25*d* causes the respective flap 21*b* or 21*d* to safely keep the respective jar 50*a* or 50*b* connected to the flap 21*b* or 21*d* after the top region of the jar 50*a* or 50*b* has been caused or permitted to slip into the extension 26*b* or 26*d* during the removal manipulation of the jar 50*a* or 50*b*, until the person desiring to remove the jar 50*a* or 50*b* is ready to dissociate the jar 50*a* or 50*b* from the flap 21*b* or 21*d*.

Figure 3:
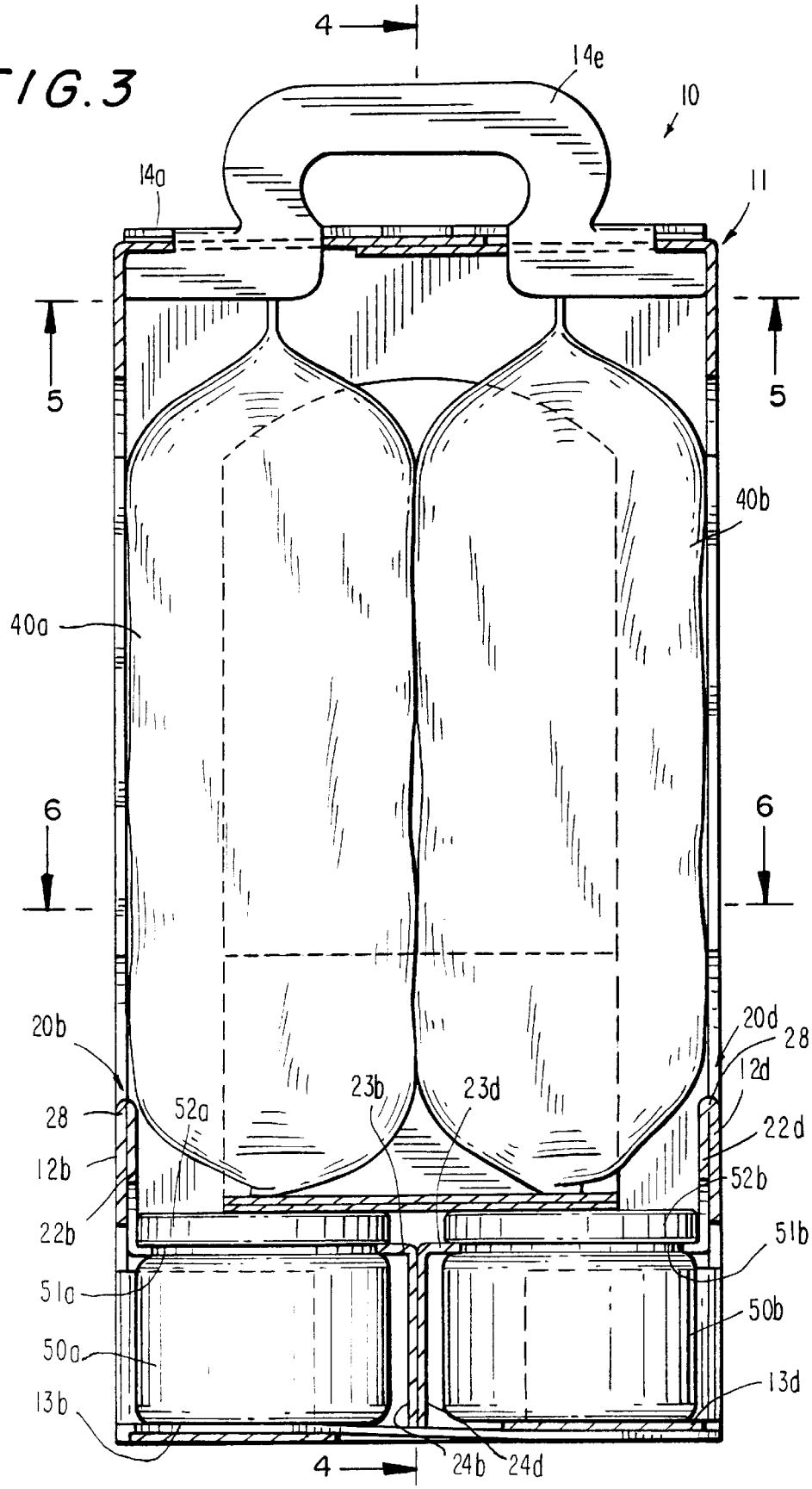
FIG. 3 is a sectional view through the snack package assembly in its use condition, taken in a plane indicated by arrows 3—3 in FIG. 1.
Figure 4:
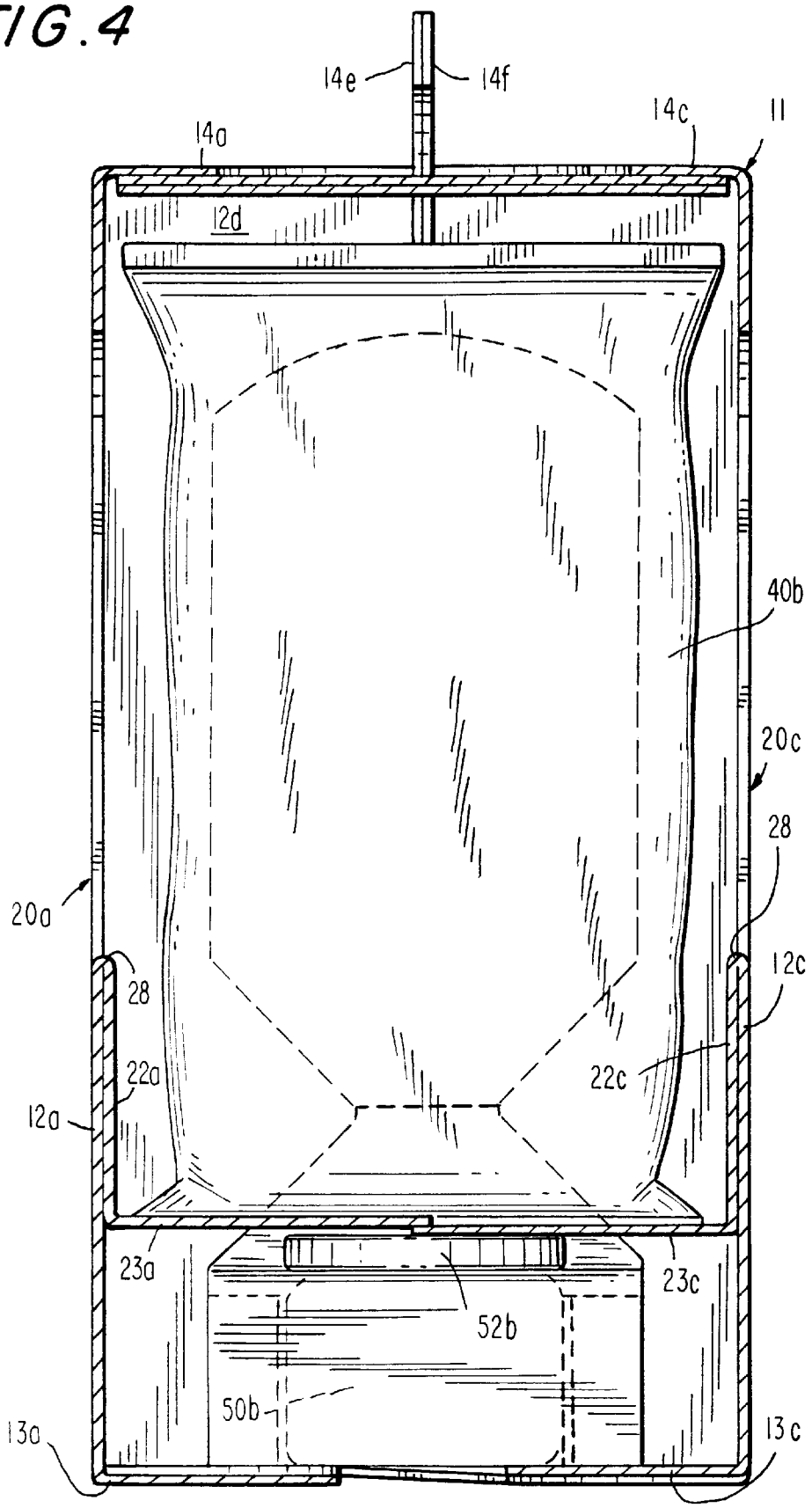
FIG. 4 is another sectional view of the snack package assembly similar to but taken along the line 4—4 of FIG. 3.

As a comparison of FIGS. 3 and 4 of the drawing will reveal, the flaps 21*a* and 21*c* initially behave the same way as described above in connection with the flaps 21*b* and 21*d*, that is their sections 22*a* and 22*c* depend downwardly from the hinge regions 28, whereas the neighboring sections 23*a* and 23*c* extend horizontally; however, here the similarity ends—there is no further continuation downward. Rather, the sections 23*a* and 23*c* merely extend toward one another and/or, as shown, actually overlap each other, to form, being supported from below by the jars 50*a* and 50*b*, a supporting platform for the bags 40*a* and 40*b*. At the same time, the sections 23*a* and 23*b* constitute an—albeit incomplete—partitioning wall that separates the compartment containing the chip bags 40*a* and 40*b* from that accommodating the sauce jars 50*a* and 50*b*.

Figure 5:
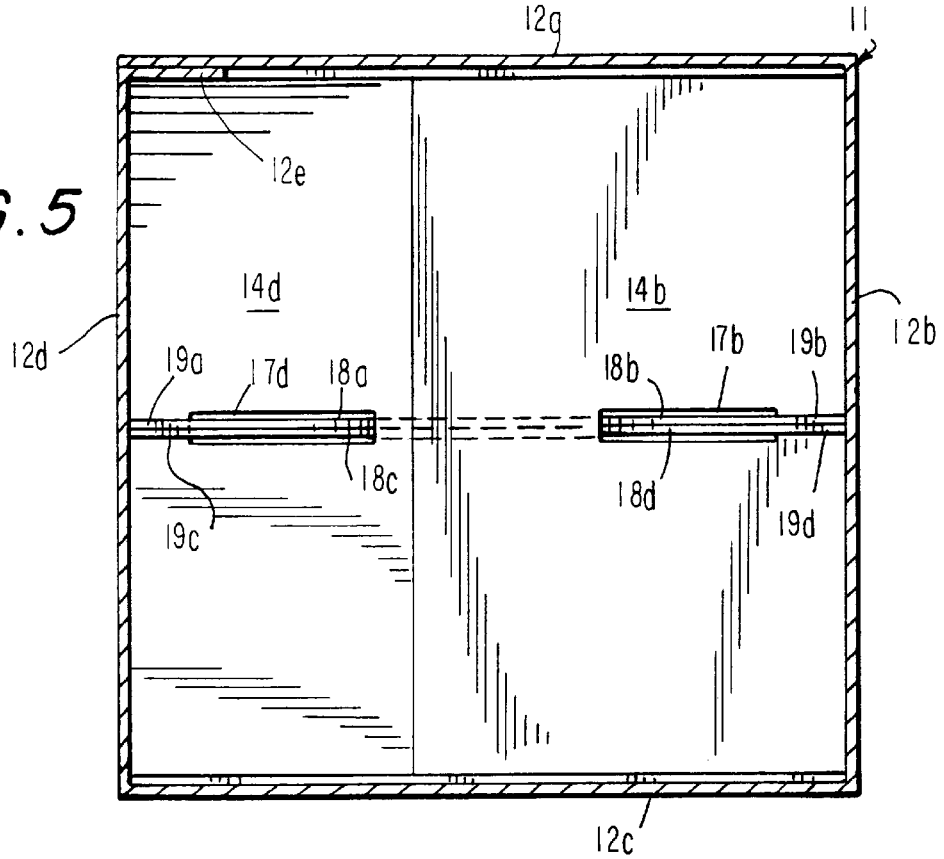
FIG. 5 is a cross-sectional view taken through the snack package assembly along the line 5—5 of FIG. 3.

FIG. 5 of the drawing illustrates, in a view from below, in additional detail how the handgrip portions 18*a* to 18*d* extend, in respective paired, mutually parallel, relationships, through the respective slots 17*b* and 17*d* of the top panels 14*b* and 14*d*, respectively, and how the noses 19*a* to 19*d* engage behind the top panels 14*b* and 14*d* from underneath, next to the slots 17*b* and 71*d*.

Figure 6:
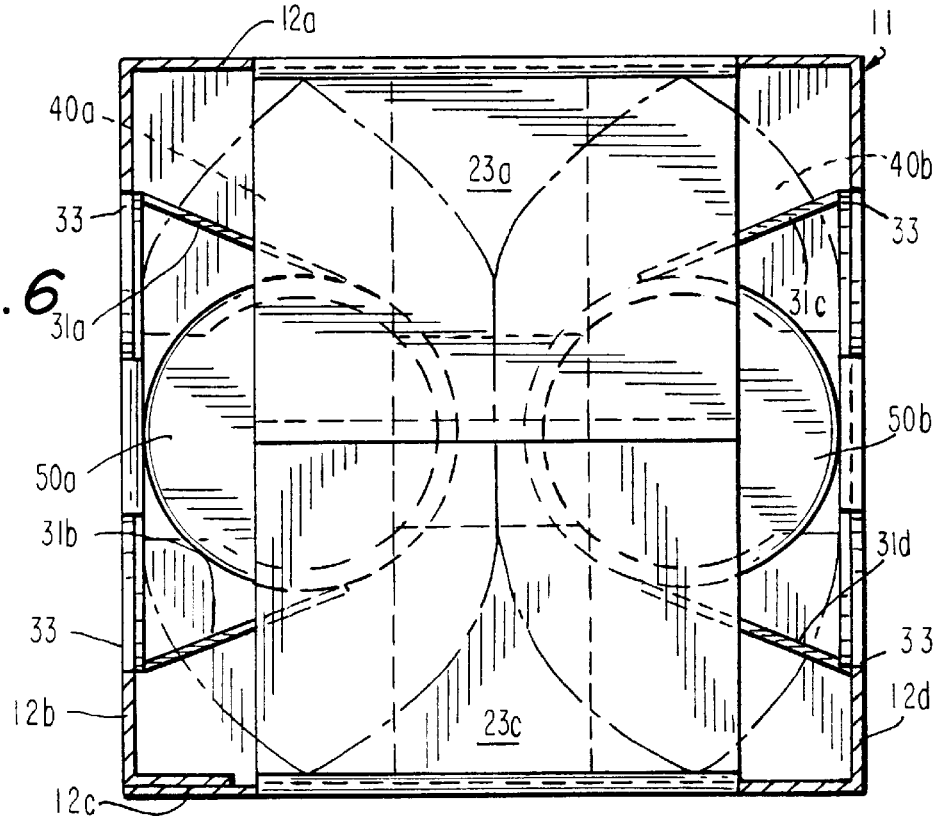
FIG. 6 is another cross-sectional view of the snack package assembly but this time taken along the line 6—6 of FIG. 3.
Figure 7:
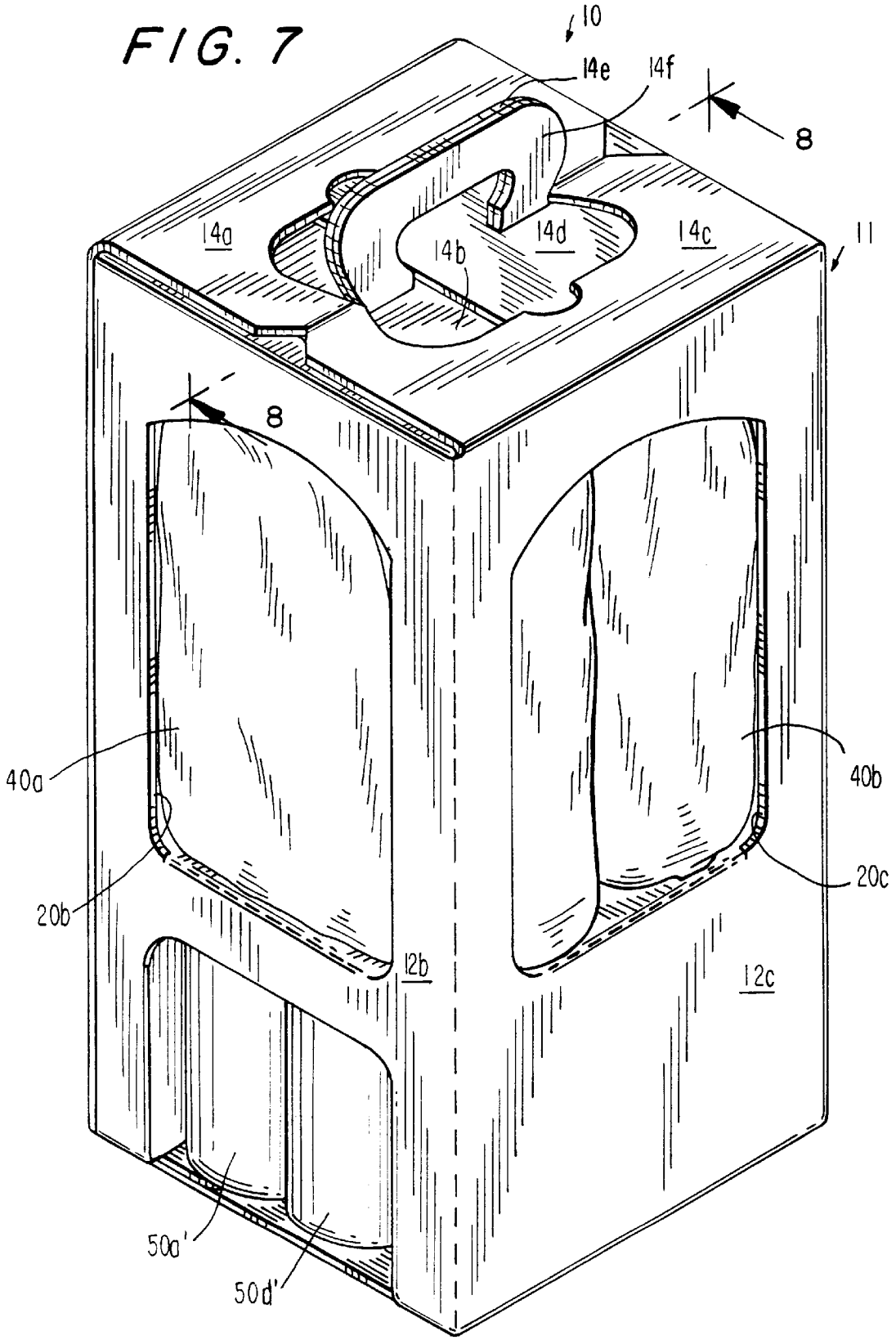
FIG. 7 is a view akin to FIG. 1, but showing a somewhat modified version of the snack package assembly of the present invention in its use condition.

FIG. 6, on the other hand, depicts in some detail what happens with the auxiliary flaps 31*a* to 31*d* in the final condition of the package assembly or snack pack 10. It may be seen there that the auxiliary flaps 31*a* to 31*d* assume respective positions corresponding to those of partially opened doors, that is they are pivoted about their respective hinge zones 33 only to the minimum extent necessary to accommodate the respective jars 50*a* and 50*b* between them. As a matter of fact, in view of the seemingly small but yet significant resiliency of the hinge zones 33, the auxiliary flaps 31*a* to 31*d* not only are in contact with the jars 50*a* or 50*b*, as the case may be, but even push against them. This provides a further amount of stabilization of the jars 50*a* and 50*b* in their designed-for positions, on top of that provided by the flap sections 21*b* and 21*d*, against horizontal displacement.

Turning now to FIGS. 7 to 11 of the drawing, it is to be mentioned first that they show a modification of the previously described package 11 that is so minor in character—involving merely dimensions and/or precise locations of certain cut and crease lines—that not only have the same reference numerals as before been used therein to designate corresponding parts, but it was even possible to eliminate the equivalent of FIG. 2 from this set of drawings as redundant. Moreover, the similarities are so numerous that it is not necessary to describe those features that correspond to those described above in detail; rather, pointing out and focusing on the differences will suffice.

The modified snack pack 10 is again intended to provide nourishment for its owner and/or his or her companions, but this time accompanied by libation instead of the aforementioned sauce. To this end, the dimensions of the entire package 11 and/or of the aforementioned upper and lower compartments adjusted, with corresponding adjustments in the sizes of the flaps 21*a* to 21*d* and 31*a* to 31*d*, to the extent necessary for the lower compartment to be able to accommodate a six-pack of cans 50*a*' to 50*f*' instead of the aforementioned jars 50*a* and 50*b*. In this case, it is not necessary to individually hold the cans 50*a*' to 50*f*' against horizontal displacement; rather, in view of the fact that respective neck portions 51*a*' to 51*f*' are connected with one another, as is customary in this field, by a plastic collar assembly 53 (usually made of shrinkable material or foil that is shrunk during the formation of the six-pack), it is merely necessary to hold the entire six-pack 50*a*' to 50*f*' in place. This can be achieved by mere wedging or frictional retention of the six-pack 50*a*' to 50*f*' in its original assembled position.

Figure 8:
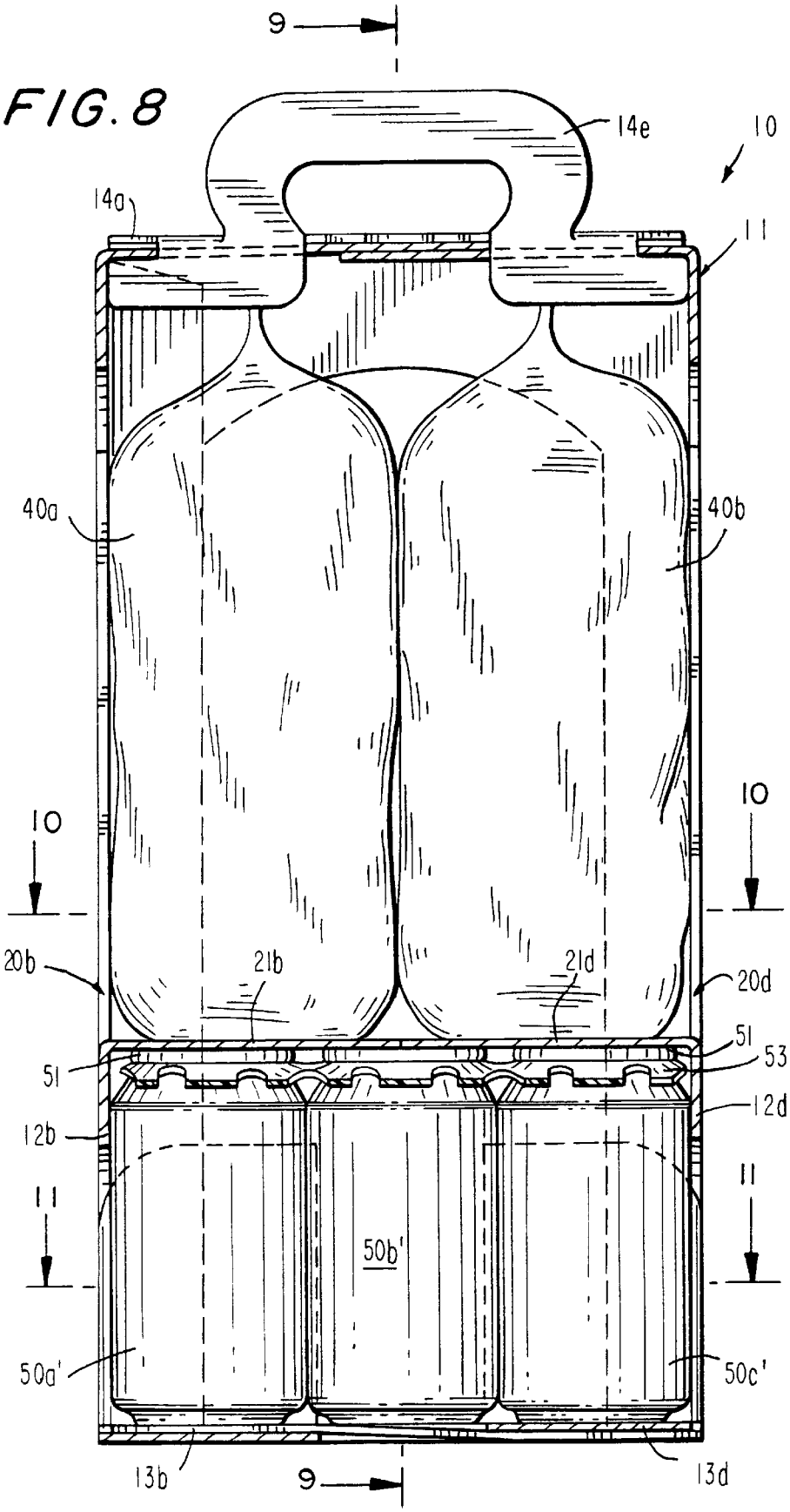
FIG. 8 is a sectional view of the modified version of the snack package, taken on line 8—8 of FIG. 7.
Figure 9:
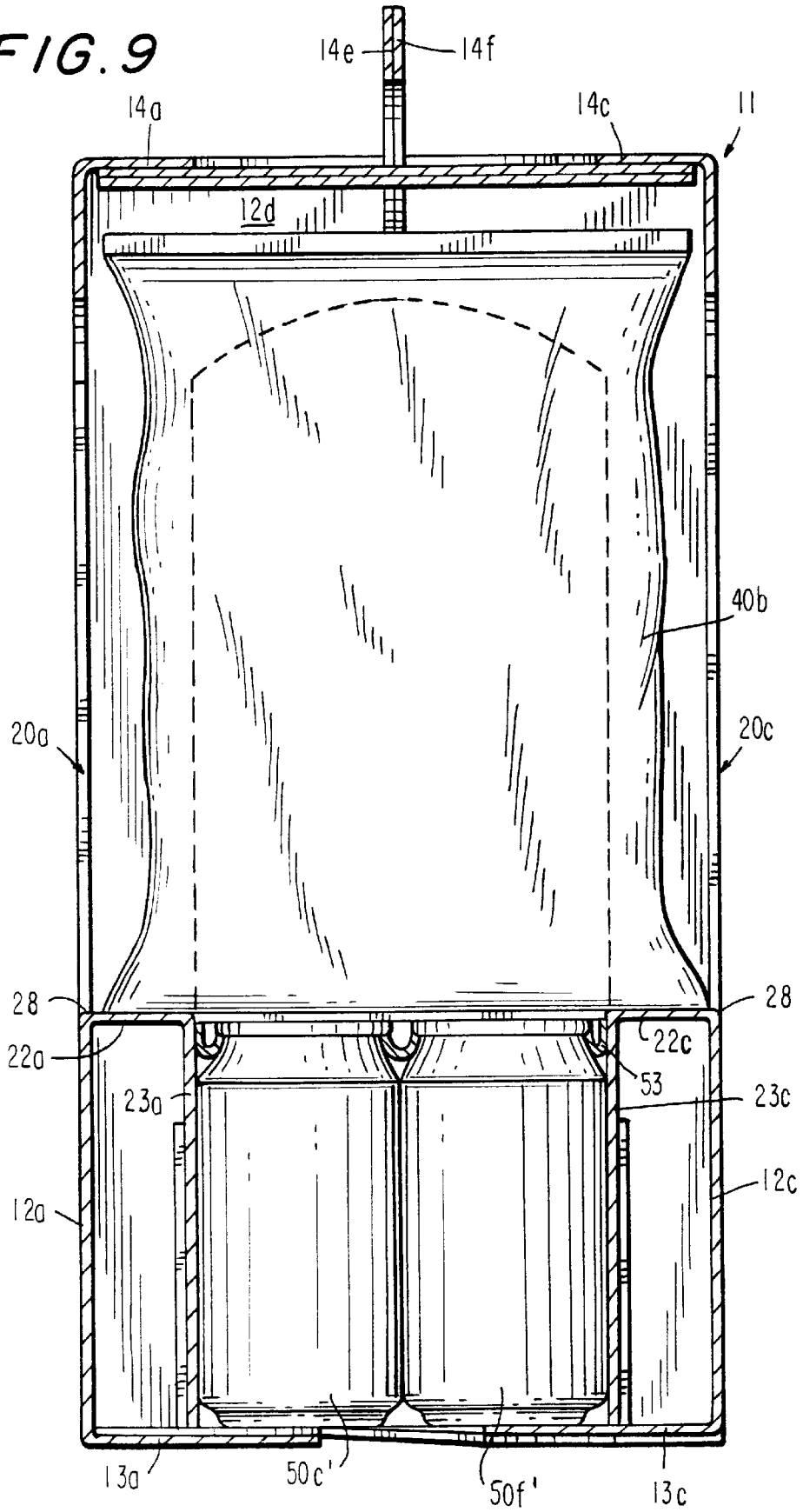
FIG. 9 is a further sectional view of the modified snack package assembly of FIG. 7 but taken on line 9—9 of FIG. 8.
Figure 10:
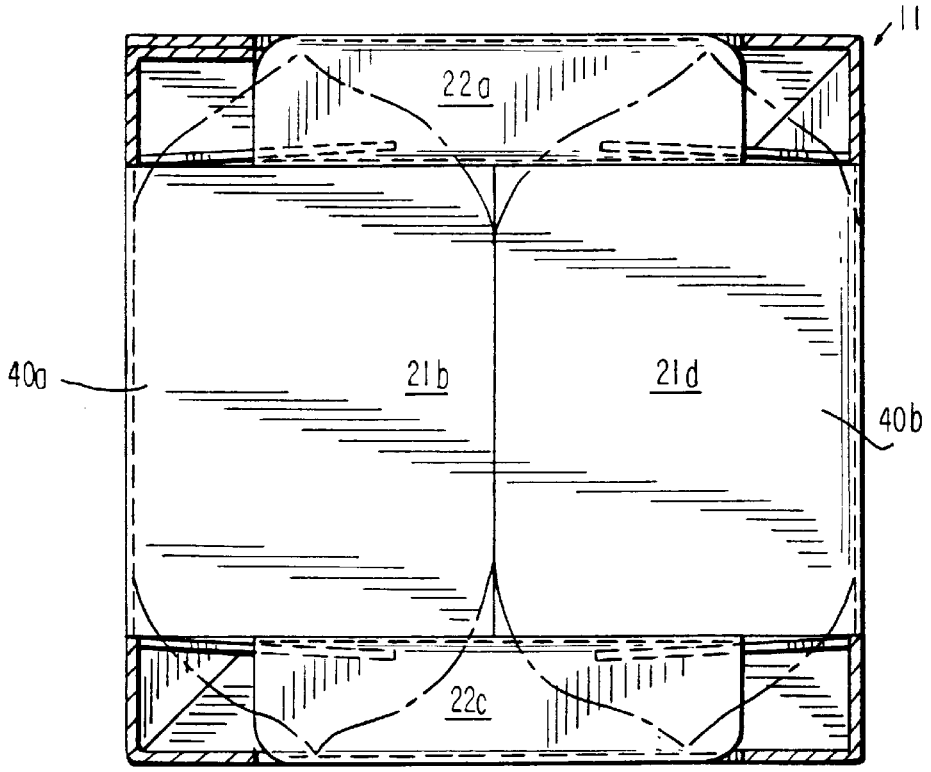
FIG. 10 is a cross-sectional view of the modified snack package assembly taken on line 10—10 of FIG. 8.

In the illustrated embodiment of the modified snack pack 10, this is accomplished, among others, by frictionally retaining the cans 50*a*' to 50*f*' between the two flaps 21*b* and 21*d* (which in this case are not subdivided into any sections) constituting the platform or partitioning wall separating the upper and lower compartments from one another and the bottom wall 13, as may be perceived in particular from FIG. 8 of the drawing. Moreover, the six-pack of cans 50*a*' to 50*f*' is confined between and pressed against by respective sections 23*a* and 23*c* of the flaps 21*a* and 21*c*, each of which is connected with its respective associated main panel 12*a* or 12*c* through the intermediary of the respective flap section 22*a* or 22*c*.

It ought to be noted that in the illustrated modified embodiment of the snack pack 10 of the present invention, the flap sections 22*a* and 22*c* form respective ledges and that the flaps 21*b* and 21*d* fit between them, so that the so formed ledges complement the aforementioned partitioning wall 21*b*, 21*d* to form a contiguous platform for supporting the chip bags 40*a* and 40*b*, with the partitioning wall 21*b*, 21*d* being again, as it was before, supported from below on top of the receptacles—this time the cans 50*a*' to 50*f*'—located underneath it, and with the flap sections 23*a* and 23*c* extending all the way to, and bracing themselves against, the bottom wall 13, thus offering an additional measure of stability to the platform supporting the chip bags 40*a* and 40*b*. This mutual complementation aspect may best be observed in FIG. 10 of the drawing.

Figure 11:
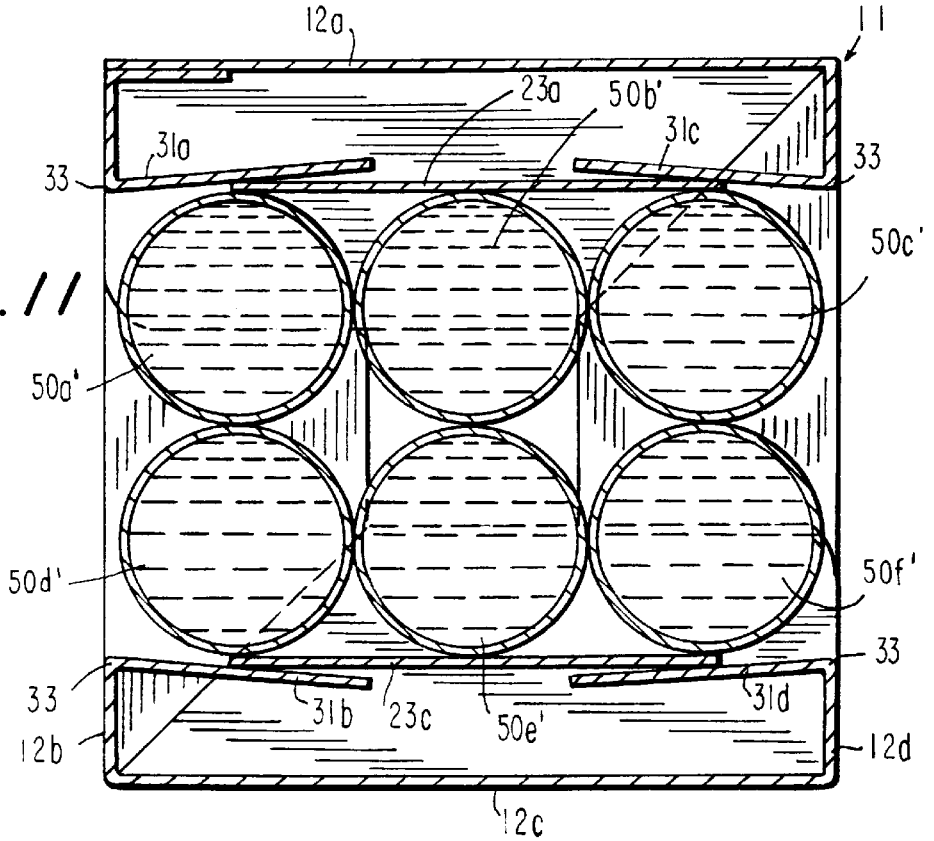
FIG. 11 is a further cross-sectional view of the modified snack package assembly taken on line 11—11 of FIG. 8.

FIG. 11, on the other hand, depicts an additional feature of the present invention, that is the use of the auxiliary flaps 31*a* to 31*d* as springs-of-sort that urge the flaps 23*a* and 23*c* towards one another and hence into a rather tight contact with the cans 50*a*' to 50*f*' located between them. To this end, the auxiliary flaps 31*a* to 31*d* extend from the respective main panels 12*b* and 12*d* to behind the flap sections 23*a* and 23*c*, so that the resiliency inherent in the bending of the auxiliary flaps 31*a* to 31*d* about the hinge zones 33 out of their coplanar positions with the respective main panels 12*b* and 12*d* into their positions shown especially in FIG. 11 results in the exertion of forces on the flap sections 23*a* and 23*c* which, albeit seemingly quite small in absolute terms, are still significant and/or decisive in the context of the present invention, in that they not only prevent the flap sections 23*a* and 23*c* from receding from the cans 50*a*' to 50*f*' but even improve the frictional engagement between the flap sections 23*a* and 23*c* and the cans 50*a*' to 50*f*'.

It will be understood that each of the elements described above, or two or more together, may also find a useful application in other types of constructions differing from the type described above.

While the present invention has been described and illustrated herein as embodied in two specific constructions of a compartmentalized snack pack, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A portable snack package assembly for transporting different types of snack items, comprising:

a) a package having top and bottom walls, and a plurality of circumferentially adjacent main walls interconnecting the top and bottom walls and bounding an interior;

b) a platform integral with the package and extending into the interior of the package between the top and bottom walls to subdivide the interior into an upper compartment for accommodating a first type of the snack items, and a lower compartment for accommodating a different second type of the snack items;

c) an upper opening extending through one of the main walls between the platform and the top wall, for providing constant external access to the upper compartment and constant external visibility to the first type of the snack items accommodated in the upper compartment;

d) a lower opening extending through one of the main walls between the platform and the bottom wall, for providing constant external access to the lower compartment and constant external visibility to the second type of the snack items accommodated in the lower compartment; and e) a handle hinged to and extending away from the top wall remotely from the openings for enabling the assembly with the different types of the snack items to be hand carried and transported.

2. The snack package assembly as defined in claim 1, wherein the top and bottom walls are planar, and wherein the plurality of the main walls constitutes four of said main walls, each of the main walls being planar and extending normal to the planar top and bottom walls.

3. The snack package assembly as defined in claim 1, wherein the top wall has two planar top wall portions; and wherein the handle has two planar handle portions hinged and extending normal to the top wall portions.

4. The snack package assembly as defined in claim 1, wherein the package has a rectangular parallelepiped shape.

5. The snack package assembly as defined in claim 1, wherein the plurality of the main walls includes a pair of side walls parallel and spaced apart from each other, and wherein the platform includes a pair of support flaps hinged to the side walls.

6. The snack package assembly as defined in claim 5, wherein the support flaps at least partly overlap each other.

7. The snack package assembly as defined in claim 5, wherein the support flaps lie in a common plane.

8. The snack package assembly as defined in claim 5; and further comprising a rigid container containing the second type of the snack items, accommodated in the lower compartment, and supportably engaging the support flaps from below to enable the platform to support the first type of the snack items.

9. The snack package assembly as defined in claim 5, wherein each support flap has a first flap section hinged to a respective one of the side walls, and a second flap section in engagement with a rigid container.

10. The snack package assembly as defined in claim 5, wherein each of the side walls has the upper opening and the lower opening.

11. The snack package assembly as defined in claim 5, wherein the plurality of the main walls includes a pair of end walls parallel and spaced apart from each other, and wherein the end walls include a pair of confining flaps hinged to the end walls.

12. The snack package assembly as defined in claim 11; and further comprising a rigid container containing the second type of the snack items, accommodated in the lower compartment, and engaged by the confining flaps to confine the rigid container against undesired movement in the lower compartment during transport.

13. The snack package assembly as defined in claim 12; and further comprising auxiliary flaps hinged to one of the main walls at the lower opening, said auxiliary flaps frictionally engaging the rigid container to assist the confining flaps in resisting undesired movement of the rigid container during transport.

14. The snack package assembly as defined in claim 12, wherein each of the confining flaps includes a first confining flap section hinged to a respective one of the end walls, and a second confining flap section extending parallel to the end walls and engaging the bottom wall in bracing contact therewith.

15. The snack package assembly as defined in claim 14, wherein the second confining flap section of each confining flap is in area contact with each other.

16. The snack package assembly as defined in claim 14, wherein the second confining flap section of each confining flap is spaced apart from each other.

17. The snack package assembly as defined in claim 14, wherein each of the confining flaps includes a third locking flap section having an aperture for unobstructed passage of an upper end portion of the rigid container.

18. The snack package assembly as defined in claim 1; and further comprising at least one bag containing the first type of the snack items, and a rigid container containing the second type of the snack items, said first type being a multitude of solid snack items, and said second type being a flowable substance.

19. A portable snack package assembly for transporting different types of snack items, comprising:

a) a package having top and bottom walls spaced apart in mutual parallelism along a first direction, a pair of side walls spaced apart in mutual parallelism along a second direction normal to the first direction, and a pair of end walls spaced apart in mutual parallelism along a third direction normal to the first and second directions, said side walls and said end walls interconnecting the top and bottom walls, all of said walls bounding an interior;

b) a platform including a pair of support flaps hinged to the side walls between the top and bottom walls to subdivide the interior into an upper compartment for accommodating a first type of the snack items, and a lower compartment for accommodating a second type of the snack items;

c) a pair of upper openings extending through one of the pairs of the side and end walls and located between the platform and the top wall, for providing constant external access to the upper compartment and constant external visibility to the first type of the snack items accommodated in the upper compartment;

d) a pair of lower openings extending through the other of the pairs of the side and end walls and located between the platform and the bottom wall, for providing constant external access to the lower compartment and constant external visibility to the second type of the snack items accommodated in the lower compartment; and e) a handle hinged to and extending away from the top wall remotely from the openings for enabling the assembly with the different types of snack items to be hand carried and transported.

* * * * *